US008716925B2

(12) United States Patent
True

(10) Patent No.: US 8,716,925 B2
(45) Date of Patent: May 6, 2014

(54) ADJUSTABLE PERVEANCE ELECTRON GUN HEADER

(75) Inventor: Richard Brownell True, Sunnyvale, CA (US)

(73) Assignee: L-3 Communications Corporation, San Carlos, CA (US)

( * ) Notice: Subject to any disclaimer, the term of this patent is extended or adjusted under 35 U.S.C. 154(b) by 194 days.

(21) Appl. No.: 13/206,294

(22) Filed: Aug. 9, 2011

(65) Prior Publication Data

US 2013/0038200 A1 Feb. 14, 2013

(51) Int. Cl.
*H01J 29/46* (2006.01)

(52) U.S. Cl.
USPC ..... 313/443; 445/34

(58) Field of Classification Search
USPC ..... 313/441–443, 459; 445/34
See application file for complete search history.

(56) References Cited

U.S. PATENT DOCUMENTS

| | | | | |
|---|---|---|---|---|
| 3,728,570 | A * | 4/1973 | Smith et al. | 250/311 |
| 6,236,713 | B1 * | 5/2001 | True et al. | 378/138 |
| 2002/0180362 | A1 * | 12/2002 | Symons | 315/3 |

* cited by examiner

*Primary Examiner* — Andrew Coughlin
(74) *Attorney, Agent, or Firm* — O'Melveny & Myers LLP

(57) ABSTRACT

In an electron gun for use in a TWT, klystron, linear accelerator or other electron device, an electron gun header assembly and an input body assembly are coupled using a flexible bellows that allows the distance between the cathode and anode to be varied. As such, the perveance of the electron gun can be tuned, and the cathode magnetic field optimized for efficient operation. In addition, an external magnetic shield is adapted to be translated along the axial dimension of the electron gun to further optimize the cathode magnetic field and focusing characteristics to achieve improved electron gun performance.

15 Claims, 8 Drawing Sheets

ADJUSTABLE PERVEANCE ELECTRON GUN HEADER

BACKGROUND OF THE INVENTION

1. Field of the Invention

The present invention pertains to the field of electron beam tubes and more particularly to an electron gun header having an adjustable perveance that enables the cathode flux to be adjusted and optimized for improved beam focusing.

2. Description of Related Art

Electron guns are well known and used in standard travelling wave tubes (TWTs), mini-TWTs, klystrons, linear accelerators, and other radio-frequency (RF) electron devices. Such devices typically cause an electron beam originating from an electron gun to propagate through an evacuated tunnel or drift tube that includes an RF interaction structure. The electron beam must be focused by magnetic or electrostatic fields, or both, within the device to minimize beam loss by collision with the walls of the device itself. For example, a TWT operates as a broad-band microwave amplifier that relies on the interaction of a propagating RF wave with the propagating electron beam. In such a tube, the focused electron beam propagates with a velocity slightly faster than that of the RF wave such that the electrons may lose kinetic energy to the wave, thus amplifying its power. Controlling the focusing and propagation of the electron beam is thus important to the performance of the TWT.

In a device such as a TWT, the electron beam is formed by an electron gun, which typically comprises an electron-emitting cathode and an anode. The cathode is typically heated to enable thermionic electron emission. When the anode is raised to a potential that is positive with respect to the cathode, the electrons begin to flow as a beam. The geometry of the anode, the cathode, and other focusing electrodes create electromagnetic fields that define the path of the electron beam. In a Pierce gun configuration, the electron beam passes through an opening in the anode to enter the main body of the electron device. In other configurations, a grid is positioned in front of the cathode and affixed to the electrically isolated focus electrode. When the grid is pulsed to a potential sufficiently negative with respect to the cathode, it cuts off the electron current flow and can be used to create a modulated or pulsed electron beam.

Many electron guns are designed to exhibit a high perveance, which is defined as the ratio of the space-charge-limited beam current to the gun cathode-to-anode voltage raised to the three halves power. A higher perveance thus indicates that the emitted electron beam is more heavily influenced by space-charge effects. In such a system, the voltage that must be applied to the focus electrode in order to completely cut off the beam current becomes very large. It would thus be beneficial to implement the gun header using a stacked ceramic structure that can support the various elements of the electron gun and also provide a high voltage standoff to support the high voltages necessary to sustain operation at a high perveance. It would also be beneficial to mechanically adjust the perveance of the electron gun and optimize the magnetic flux at the cathode to achieve improved beam focusing.

SUMMARY OF THE INVENTION

The invention is directed to an electron gun header having an adjustable perveance. In one embodiment of a gun header in accordance with the present invention, a novel vacuum enclosure comprises a stacked ceramic structure to support the structural elements of the electron gun and further to provide a high-voltage standoff to enable operation at voltages substantially higher than those of standard mini-TWT pin-type gun headers. In addition, the gun header includes a bellows assembly and other non-magnetic and magnetic elements that enable the cathode flux to be adjusted and optimized for improved beam focusing and electron gun performance.

In one embodiment of a gun header assembly in accordance with the present invention, the gap between the cathode and anode of the electron gun is configured to be mechanically adjustable by the bellows assembly in order to vary the perveance. In addition, magnetic field adjustment in the electron gun region can be accomplished using magnetic elements that are not affixed to the main body of the electron tube. A feature of certain embodiments of the present invention is that during the perveance adjustment process, no magnetic parts are bent or deflected. It is well known in the art that bending magnetic parts can cause work hardening of the material that reduces its ability to support the levels of flux intensity required for good and reliable beam focusing. The perveance adjustment process associated with certain embodiments of the present invention preserves axial alignment between gun elements and maintains azimuthal uniformity of the magnetic field in order to provide excellent beam focusing.

In a first embodiment in accordance with the present invention, an electron gun assembly comprises (1) a gun header assembly that includes a cathode adapted to emit an electron beam, wherein the cathode is coupled to a cathode lead connection permitting a cathode voltage bias to be applied to the cathode; a focus electrode fixed in position adjacent to the cathode but electrically isolated from the cathode, wherein the focus electrode is further coupled to a focus electrode lead connection permitting a focus electrode voltage bias to be applied to the focus electrode; and a plurality of ceramic isolating rings fixed in position such that at least one of the plurality of ceramic isolating rings provides electrical isolation between the cathode lead connection and the focus electrode lead connection; and (2) an input body assembly including an anode configured to be adjustably held in place with respect to and in proximity to the cathode and further configured such that an anode voltage potential can be applied to the anode; and a magnetic gun polepiece fixed with respect to the anode but adjustably held in place with respect to the cathode; wherein the input body assembly and the gun header assembly are mechanically coupled using a flexible bellows that enables the input body to be translated axially with respect to the gun header assembly such that a distance between the anode and the cathode and a distance between the magnetic gun polepiece and the cathode can be adjusted.

In a preferred embodiment in accordance with the present invention, the flexible bellows is made of a material that is nonmagnetic. In another embodiment in accordance with the present invention, the anode is configured to have a geometry that is substantially ring-shaped, such that the anode includes a central void through which the electron beam can propagate. Such a configuration is known in the art as a Pierce gun configuration.

In some embodiments in accordance with the present invention, the cathode is coupled to a cathode heater assembly such that the cathode can be heated to enable thermionic emission. However, a cold-cathode configuration may also be employed and would fall within the scope and spirit of the present invention.

In some embodiments in accordance with the present invention, a grid is positioned in front of the cathode and affixed to the electrically isolated focus electrode. In the case of a negative grid gun, the grid may range from a few volts negative with respect to cathode to a potential sufficiently negative with respect to cathode to suppress all emitted current. In the case of an intercepting gridded gun, a similar grid may be pulsed from level of a few hundred volts positive, enabling current flow, to a level a few hundred volts negative, cutting off all current flow. Other arrangements of grids such as shadow grids and tetrode grids may also be employed and would fall within the scope and spirit of the present invention.

In some embodiments of an electron gun in accordance with the present invention, the input body further includes a plurality of magnetic polepieces separated by nonmagnetic spacers to form a drift region for the electron beam. The electron gun may also be configured such that the plurality of ceramic isolating rings in the gun header assembly are made from an alumina ceramic material.

Further, in some embodiments of an electron gun in accordance with the present invention, the electron gun is surrounded by a nonmagnetic gun shield having a substantially cylindrical shape, such that it substantially encloses the gun header assembly. The electron gun may further include a magnetic flux adjustment shield having a substantially cylindrical shape and located outside of the nonmagnetic gun shield. The magnetic flux adjustment shield is configured such that it can be translated in an axial direction, causing an adjustment of the magnetic field within the gun header region. The adjustment of the magnetic field serves to optimize the cathode flux and electron beam focus. Further, the adjustment of the flexible bellows to alter the distance between the cathode and anode serves to adjust the perveance of the gun assembly.

Those skilled in the art will realize other embodiments and applications of the techniques and structures disclosed, and such will also fall within the scope and spirit of the present invention. The invention is described in detail below with reference to the attached sheets of drawings that are first described briefly. In the drawings, reference designators that appear in more than one drawing refer to corresponding physical structures.

DETAILED DESCRIPTION OF THE PREFERRED EMBODIMENTS

Figure 1:
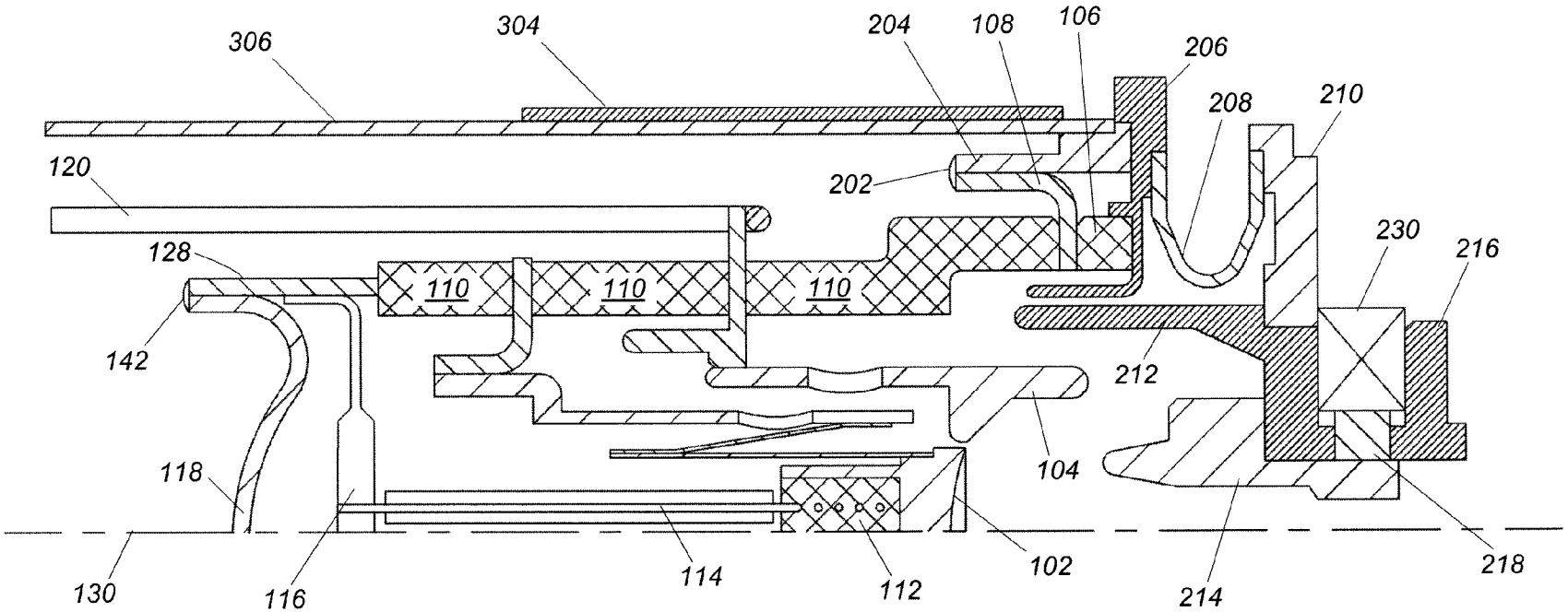
FIG. 1 is a cross section of an electron gun assembly in accordance with an embodiment of the present invention.

The invention is directed to an electron gun header having an adjustable perveance. FIG. 1 is an axial cross section depicting features of an embodiment of an electron gun in accordance with the present invention. Centerline 130 represents the axis of symmetry. The cathode 102 includes a potted heater assembly 112. One leg of the heater in assembly 112 is connected to the cathode head 102 and the other leg is electrically connected through lead 114 to ribbon 116 to rear flange 128 to cathode end cap 118. The cathode end cap 118 includes a lead similar to 120 as shown in FIG. 3 as lead 310. End cap 118 is sealed to flange 128 by weld joint 142 to produce a hermetic seal to support a vacuum in the gun region. The cathode 102 is mechanically supported near focus electrode 104. The focus electrode 104 is electrically isolated from the cathode 102 and is coupled to the focus electrode lead 120. The cathode 102 is electrically connected through metallic structures to a cathode flange lead similar to 120 (rotated in azimuth as shown in FIG. 3 as lead 320). Ceramic rings 110 provide mechanical support and also maintain isolation between the cathode 102 and the focus electrode 104. In a preferred embodiment, the ceramic rings 110 comprise alumina ceramics, although other materials may also be used. Weld flange 108 is used to connect the gun assembly of FIG. 1 to the input body assembly depicted in FIG. 2, discussed below. Ceramic ring 106 is interposed between the gun assembly of FIG. 1 and the rest of the input body depicted in FIG. 2.

Figure 2:
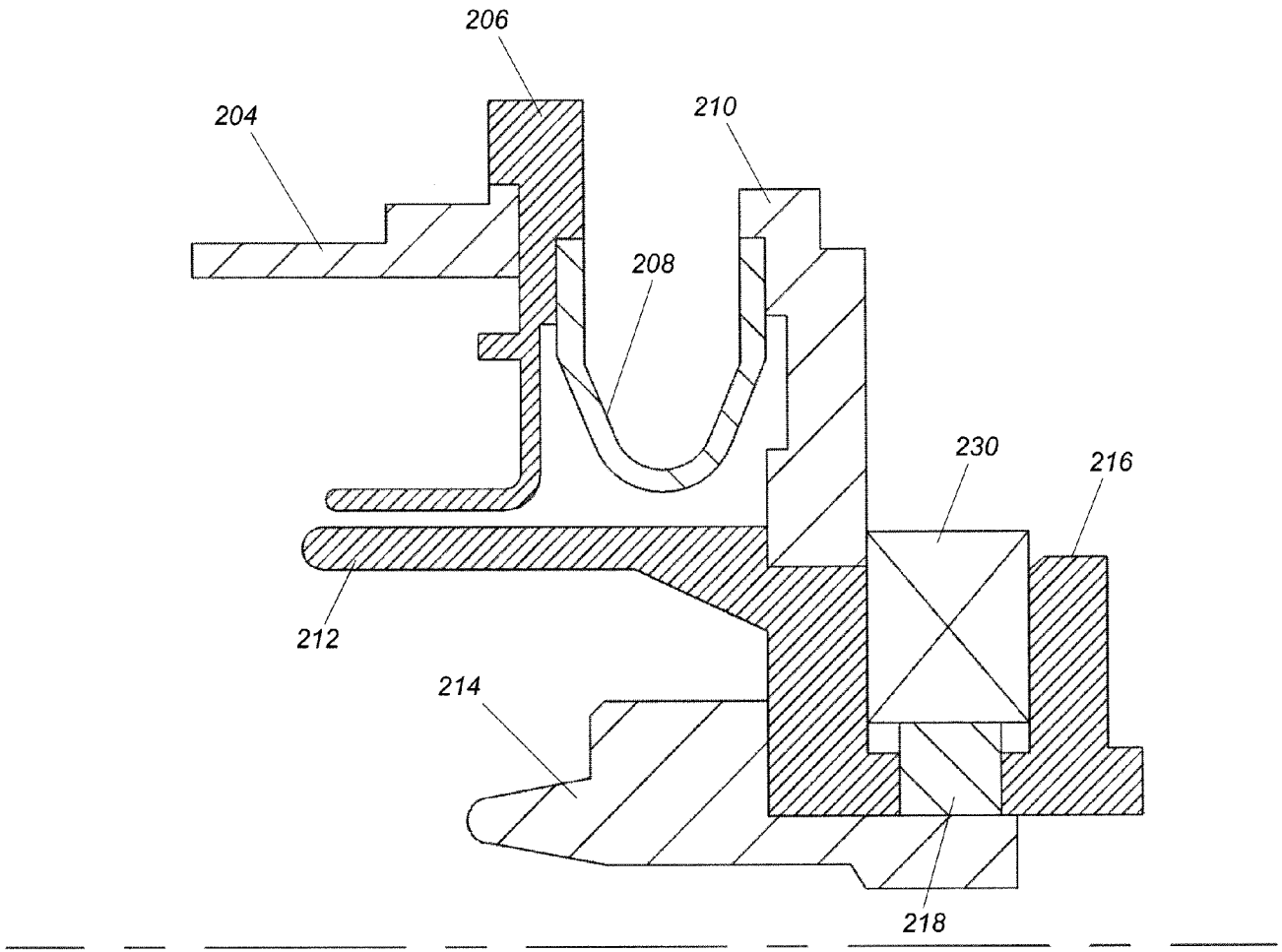
FIG. 2 is cross section of an input section of an electron gun in accordance with an embodiment of the present invention.
Figure 3:
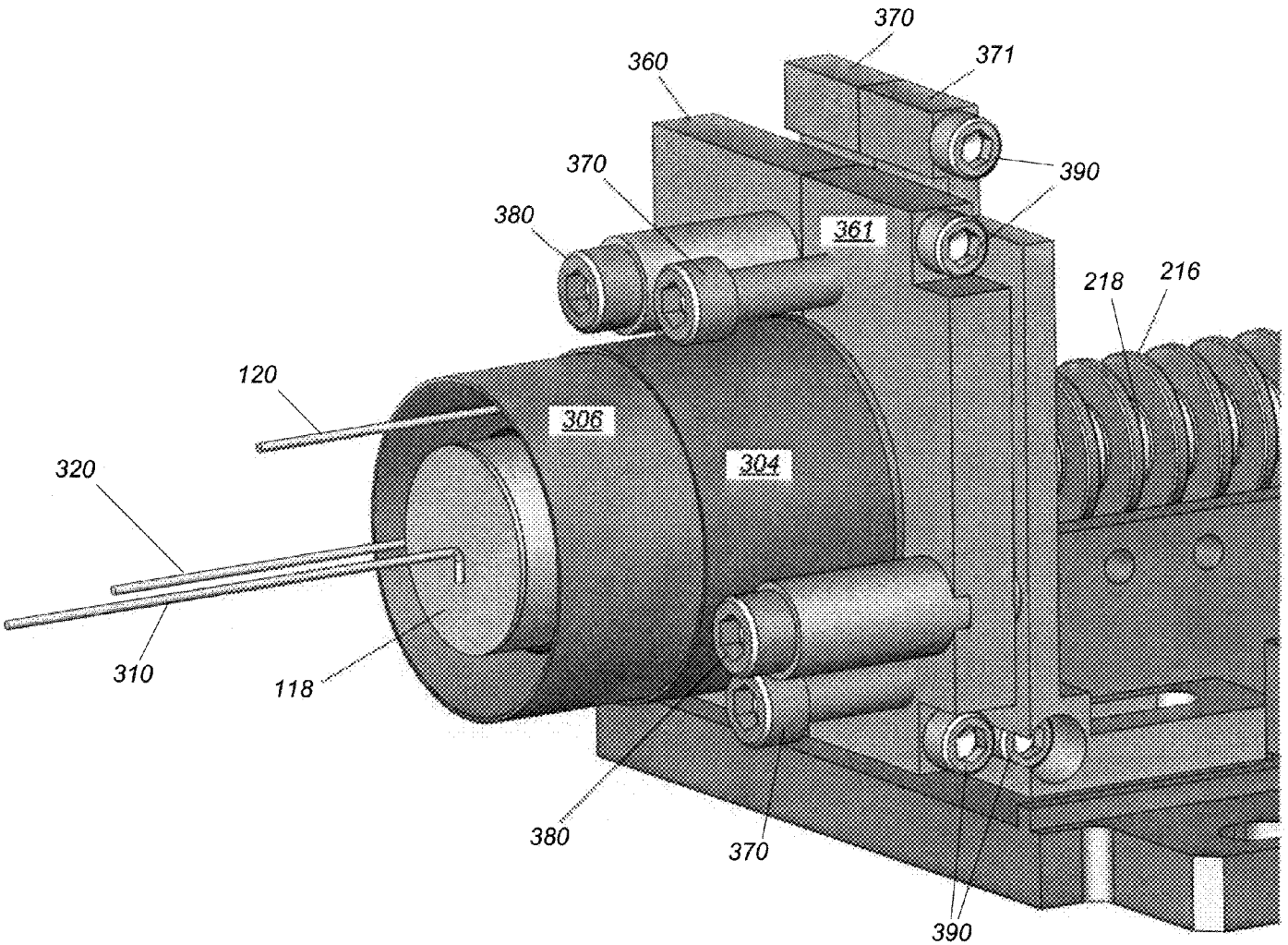
FIG. 3 is a three-dimensional drawing of an electron gun and perveance setting fixture in accordance with an embodiment of the present invention.

FIG. 2 is a cross section of an embodiment of an input section of an electron device in accordance with the present invention. Parts made from magnetic material such as soft iron are shown with dense crosshatching in FIGS. 1 and 2. Referring to FIGS. 1 and 2, nonmagnetic weld flange 108 is sealed to nonmagnetic ring 204 by weld joint 202 to produce a hermetic seal to support a vacuum in the gun and input section regions. A magnetic gun adjustment disk 206 is supported by nonmagnetic ring 204 and can be used to adjust the focus of the electron beam emitted by the cathode 102. Magnetic gun polepiece 212 is situated in proximity to the focus electrode 104, cathode 102, and anode 214. Translating the polepiece 212 axially toward or away from cathode 102 changes the focusing behavior of the electron beam. To enable axial movement of the polepiece and anode with respect to the cathode, a flexible bellows 208 is used to attach the magnetic gun adjustment disk 206 and a structural body adjustment disk 210 that is preferably made from a nonmagnetic material. It is preferred that the bellows 208 is made from a nonmagnetic material because it is known in the art that bending of magnetic parts can cause work hardening of the material, which reduces their ability to support sufficient magnetic flux densities to achieve good focusing. Adjusting the distance of the cathode 102 to the anode 214 by flexing the bellows 208 changes the beam current or gun perveance, where perveance is current divided by anode voltage to the 3/2 power. Additional magnetic polepieces 216, spacers 218, and ring magnets 230 form part a periodic permanent magnet (PPM) structure used to focus the electron beam downstream within the drift chamber. Although the embodiment depicted in FIGS. 1 and 2 includes a heated cathode, cold-cathode configurations are also possible, and the perveance-adjusting features of the present invention would apply in the same way to such a configuration.

The electron gun and input body structure depicted in FIGS. 1 and 2, according to an embodiment of the present invention, thus enable the adjustment of the gun perveance and provide for optimized cathode flux and improved beam focusing. The stacked ceramic structure of the gun allows it to be operated at substantially higher voltages than standard electron gun headers. Adjustment of the spacing between the cathode 102 and anode 214 and magnetic gun polepiece 212 can be accomplished by a setting jig which captures the outer portion of the gun adjustment disk 206 and the outer portion of the structural body adjustment disk 210. All parts of the setting jig including the screws are made from nonmagnetic materials. FIG. 3 shows such a setting jig comprised of a body clamp 370 and 371 and gun clamp 360 and 361. The setting jig includes three push screws 370 and three pull screws 380 that enable the position of cathode 102 to be precisely set with respect to anode 214. Additional magnetic polepieces, e.g., 216, are interposed with non-magnetic spacer rings, e.g., 218, along the drift tube. These, along with ring magnets 230 of alternating polarity (not shown in FIG. 3), comprise the PPM focusing structure.

Further, in accordance with an embodiment of the present invention, FIGS. 1 and 3 show a nonmagnetic gun shield 306 surrounded by a magnetic flux adjustment shield 304. Moving the magnetic flux adjustment shield 304 axially along the gun shield 306 allows for further adjustment of the flux at the cathode for further optimization of the electron beam focusing properties.

Figure 4:
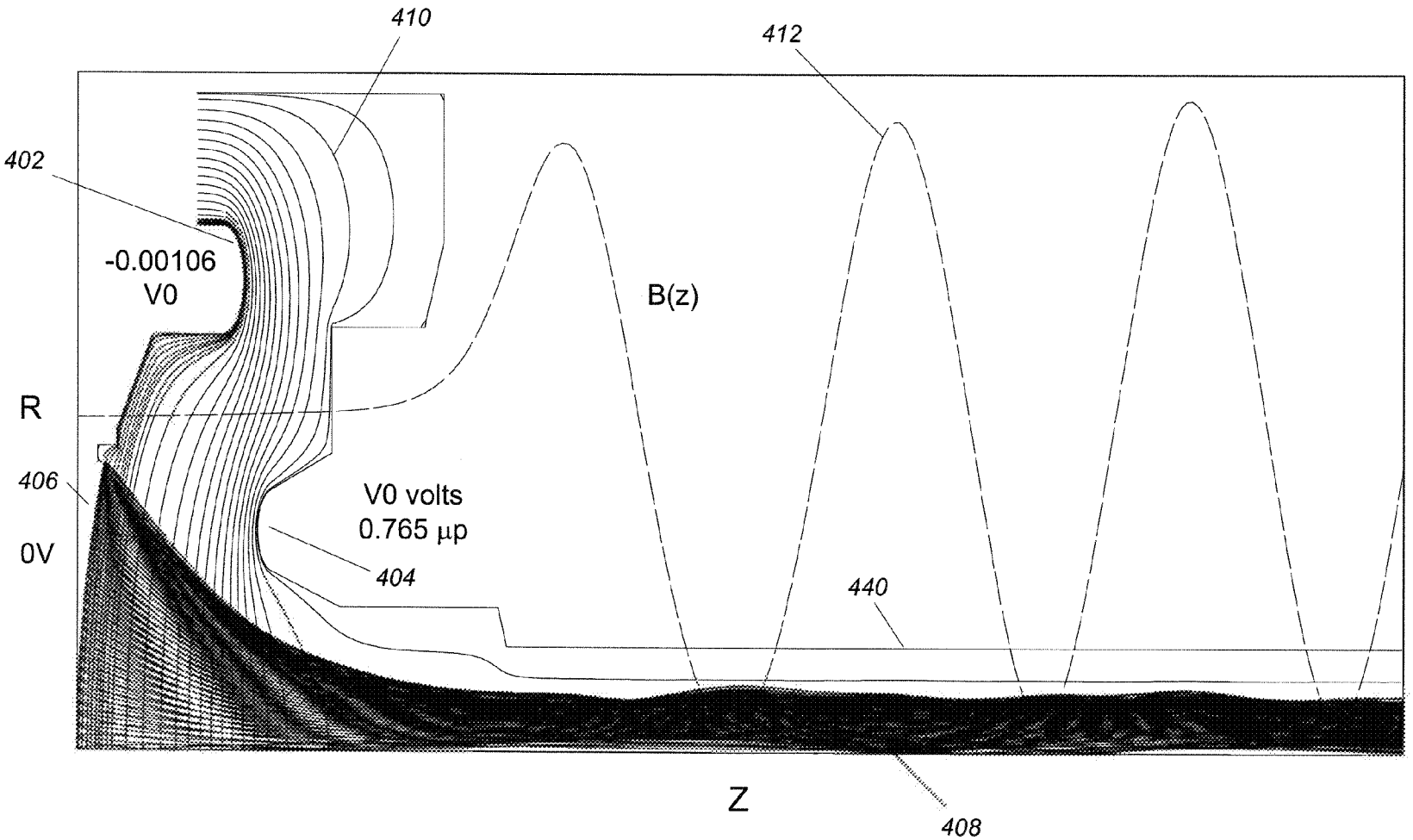
FIG. 4 is a plot of a DEMEOS electrical simulation of an embodiment of an electron gun in accordance with an embodiment of the present invention.
Figure 5:
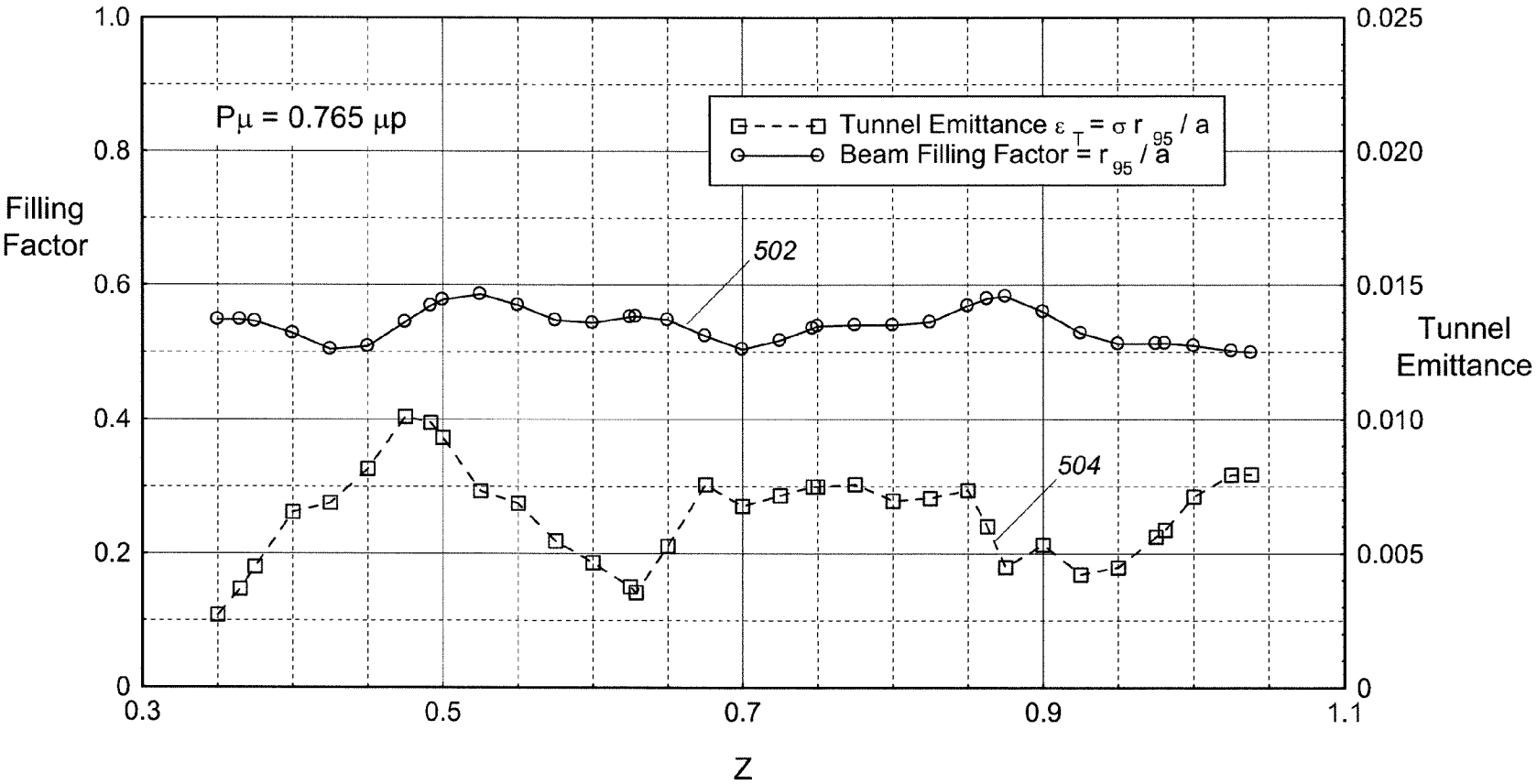
FIG. 5 is a plot of the beam filling factor and the tunnel emittance as a function of z-distance along the axis of the electron gun simulation depicted in FIG. 4.

FIG. 5 depicts the results of an electromagnetic simulation using the DEMEOS electron optics computer code. The geometry of an electron gun in accordance with an embodiment of the present invention is simulated to include a cathode 406 in proximity to a focus electrode 402 and an anode 404. In this simulation, the cathode 406 is set at a potential of 0 V. Anode 404 is set to V0 volts, and focus electrode 402 is set at a voltage of −0.00106 times V0, just slightly negative with respect to the cathode. A thermal or finite emittance electron beam model is used in the DEMEOS simulations and results of FIGS. 4 through 8. Cathode-to-anode voltage, V0, ranges from 4 to 8 kV in these plots. However, voltages outside this range can also be applied. In actual guns, the reference for voltage is typically shifted so that the anode is at ground potential or 0 volts and the cathode is at minus V0.

In FIG. 4, Voltage equipotential lines 410 illustrate the simulated electric potential within the gun region. Electrons are drawn from the cathode and are focused into a beam 408 by the electric field between the cathode and the anode and the applied magnetic field 412. In FIG. 4, the level of flux at the cathode has been adjusted by the apparatus and method described above to be 0.63 of the main PPM rms focusing field in accordance with the theory of the inventor. Note that in a PPM focusing system the flux at the cathode can be plus or minus since the value of the B field downstream is sinusoidal. In the case of FIG. 4, flux density B at the cathode 406 is negative respect to the first magnetic peak. Further, the value of the first magnetic field peak can be adjusted to achieve an optimal match between the magnetic field at the cathode 406 and the magnetic field downstream. As a result of these adjustments, the focused beam is smooth and of extremely high quality. Note that these results are representative of a particular simulation of a gun header and input section in accordance with the present invention and are meant to be illustrative of gun performance and not limiting in any way.

FIG. 5 provides an additional illustration of the performance of the electron gun of FIG. 4. FIG. 5 shows beam filling factor as a function of z distance along the gun axis. The beam filling factor is defined as the 95% beam radius divided by the inner radius of the tunnel through which the beam propagates 440. In the case of microwave tubes, this tunnel radius is the inner radius of the RF interaction structure. In other words, this metric provides an indication of how well the focusing fields are keeping the electron beam away from the walls of the RF interaction structure. The tunnel emittance 504 is a further measure of beam quality. It is defined as the product of the beam filling factor and the standard deviation of the normalized transverse velocity distribution of the electron beam (parameter sigma). The value of tunnel emittance is quite low in comparison to other guns and beam focusing designs. Further, the model indicates that the emittance is not growing with distance downstream. This is a manifestation of flux at the cathode introduced by the apparatus and methods of this patent. These performance parameters have been achieved by one embodiment of an electron gun in accordance with the present invention. Again, FIG. 5 is meant to be illustrative of the performance achieved by a particular embodiment of an electron gun in accordance with the present invention and is not intended to be limiting.

Figure 6:
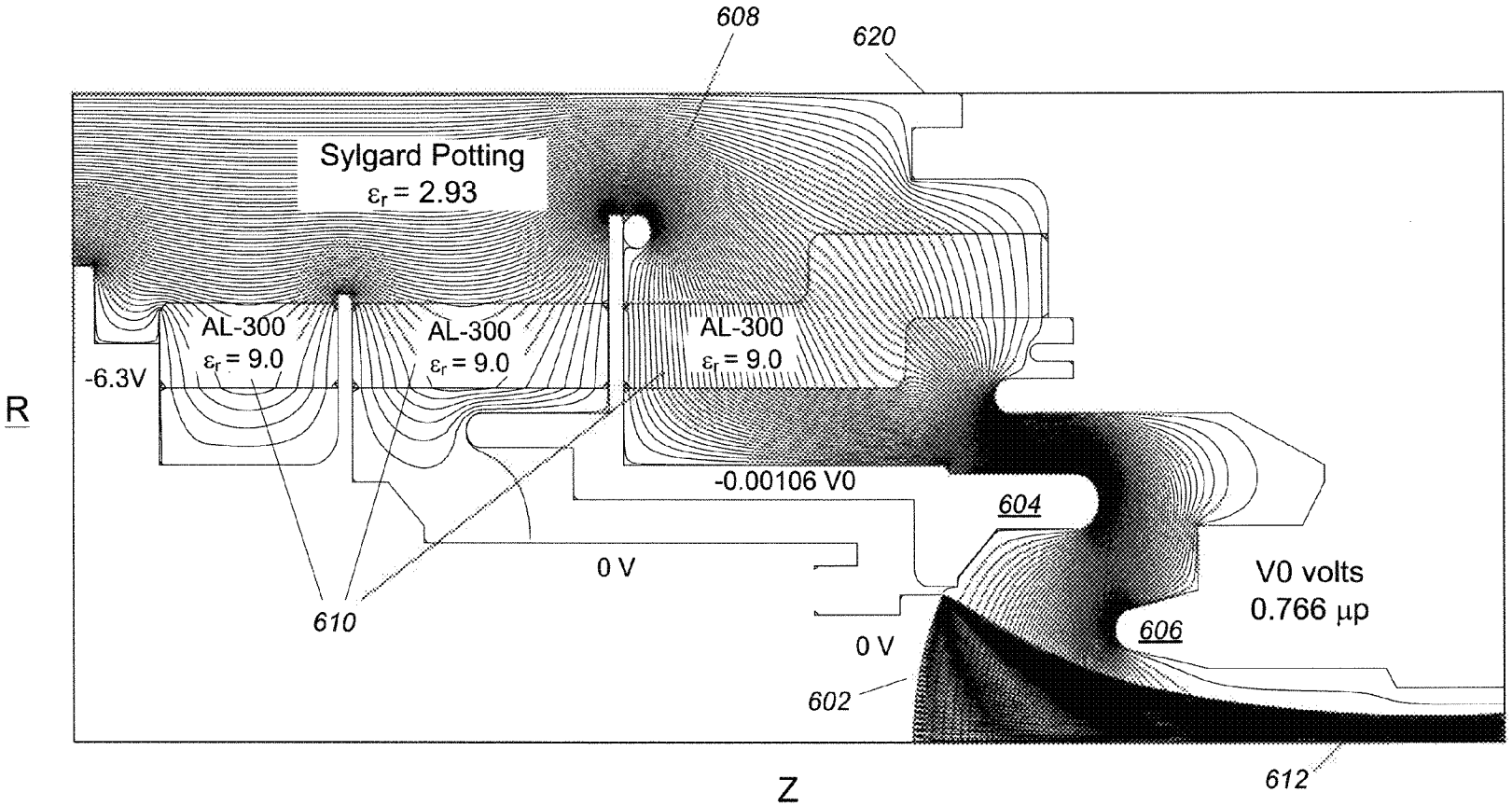
FIG. 6 is a DEMEOS simulation plot of an embodiment of an electron gun in accordance with an embodiment of the present invention showing normal beam focusing.
Figure 7:
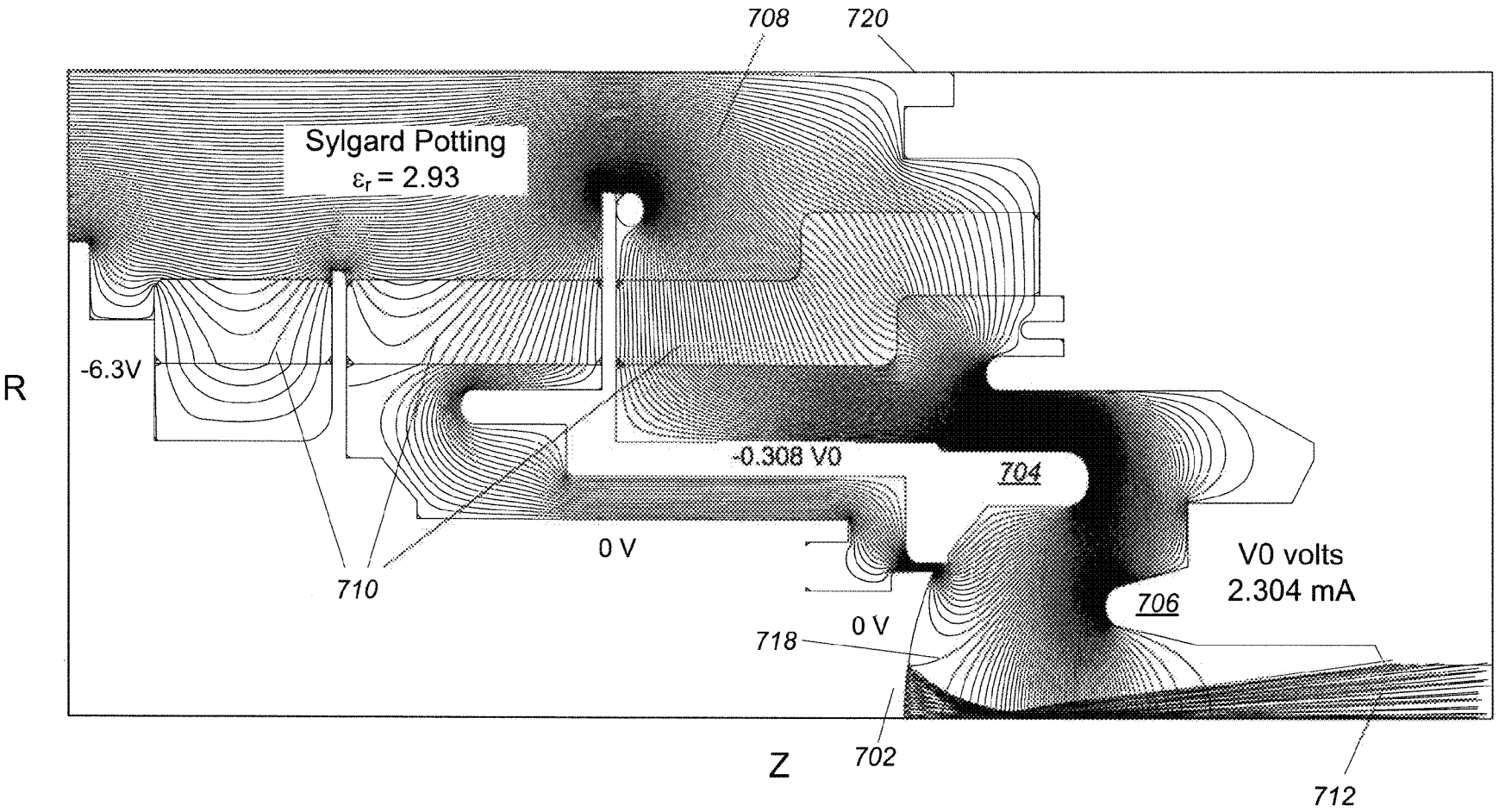
FIG. 7 is a DEMEOS simulation plot of an embodiment of an electron gun in accordance with an embodiment of the present invention showing the effect of negative focus electrode voltage on the electron beam.

FIG. 6 depicts an additional DEMEOS electromagnetic simulation of an electron gun header and input section in accordance with an embodiment of the present invention. The geometry of the electron gun and input section is simulated to include alumina ceramic insulators 610, an electron-emitting cathode 602, a focus electrode 604, and an anode 606. In this simulation, the cathode 602 is held at 0 V, the focus electrode 604 is set just slightly below the cathode potential at −0.00106 times V0, and the anode 606 is set to V0 volts, drawing electrons from the cathode 602. The resulting electric potential 608 within the gun focuses the electrons into a highly laminar beam 612. Further inspection of this plot discloses low electrostatic field levels in this configuration resulting in reliable high voltage standoff. Note that the region between the alumna insulators 610 and the nonmagnetic gun shield 620 includes a rubberized potting material which may be Sylgard or other commercially available potting compound. The embodiment depicted in FIG. 7 also includes this potting material. In FIGS. 6 and 7, the heater voltage is −6.3 volts below the potential of the cathode.

FIG. 7 depicts an additional DEMEOS simulation of the gun of FIG. 6 in which the cathode 702 held at a potential of 0 V and the anode 706 at a potential of V0 volts. However, in this case, the focus electrode 704 has been switched to a potential of −0308 times V0, which changes the voltage potential 708 within the gun and partially cuts off the flow of electrons from the cathode. It can be seen that electron flow occurs below the 0 volt equipotential 718 and is completely suppressed above it. The intensity of the electron beam 712 is reduced in comparison to FIG. 6 and it can be seen that at least a portion of the beam impinges on the anode 706. FIGS. 6 and 7 do not include any magnetic focusing field, which is why a portion of the emitted beam is striking the anode. Further, in the gun of FIG. 7, if −0360 times V0 is applied to focus electrode 704, 100% of the cathode current is suppressed. As in FIG. 6, this case illustrates that the electrostatic field levels are also low, resulting in reliable high-voltage standoff. Because the potential of the focus electrode is maximum, referenced to the nonmagnetic gun shield 720, and the voltage across the gap between the focus electrode 704 and cathode 702 is higher than in the case of FIG. 6, it is significant that the design possesses adequate design margin under these conditions.

Figure 8:
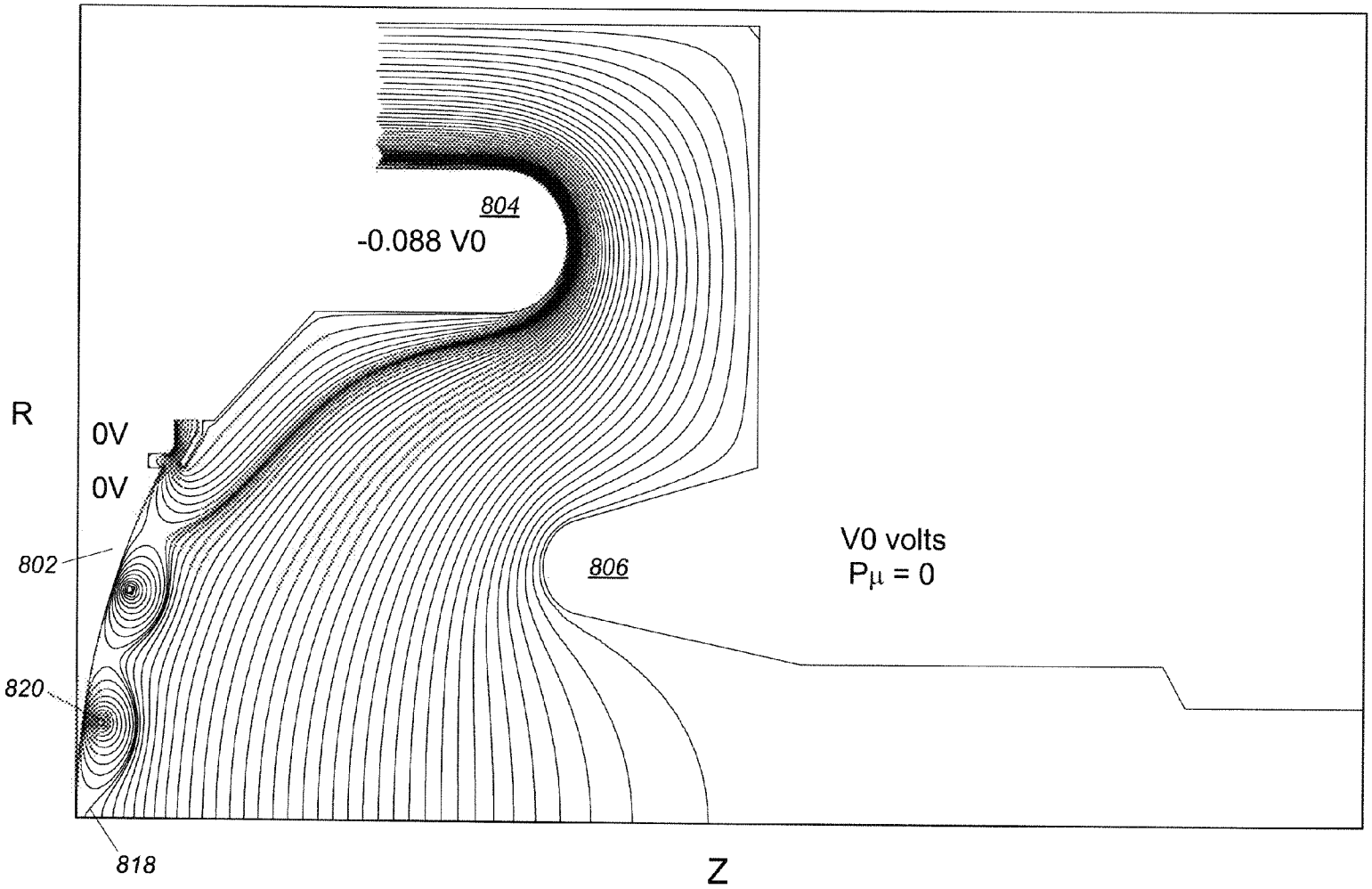
FIG. 8 is a DEMEOS simulation plot of an embodiment of an electron gun in accordance with an embodiment of the present invention illustrating negative grid cutoff.

FIG. 8 shows a DEMEOS simulation of a gun with a grid 820 affixed to focus electrode 804 and positioned in front of cathode 802. When the grid is set to a negative potential with respect to the cathode and equal to the cut off voltage, all electron current from the cathode ceases to flow. The cutoff voltage in this case is −0.088 times V0, where V0 is the applied anode voltage. It can be seen that the 0 volt equipotential 818 is everywhere in front of cathode 802. Thus, the negative electrostatic fields in front of the cathode suppress all cathode current. In this particular embodiment of an electron gun in accordance with the present invention, the grid thus provides a structure and method of reducing the magnitude of negative voltage required to cut off all beam current.

In summary, a robust and high-performance electron gun and input section are disclosed that provide the ability to tune the gun perveance and cathode magnetic field in order to adjust the electron beam focus and device performance. This is accomplished by movement of the anode and magnetic polepiece with respect to the cathode by providing a flexible bellows section that seals the vacuum chamber while allowing for axial translation. Further adjustment of the cathode flux can be accomplished by adjustment of the value of the first magnetic field peak and the adjustment of an external magnetic flux shield. The disclosed configuration has the advantage that no magnetic parts need be bent or flexed in making adjustments to the perveance. This preserves the ability of the magnetic parts to handle large magnetic fluxes necessary for good focusing performance. While the principles and techniques of the present invention are disclosed herein with respect to particular embodiments of an electron gun header and input section, the invention is not limited to the particular configurations discussed. Those skilled in the art will appreciate other embodiments and applications of the novel techniques disclosed herein, and such would also fall within the scope and spirit of the present invention. The invention is further defined by the following claims.

What is claimed is:

1. An electron gun assembly comprising:

a gun header assembly comprising:

a cathode adapted to emit an electron beam, wherein the cathode is coupled to a cathode lead connection permitting a cathode voltage bias to be applied to the cathode;

a focus electrode fixed in position adjacent to the cathode but electrically isolated from the cathode, wherein the focus electrode is further coupled to a focus electrode lead connection permitting a focus electrode voltage bias to be applied to the focus electrode; and a plurality of ceramic isolating rings fixed in position such that at least one of the plurality of ceramic isolating rings provides electrical isolation between the cathode lead connection and the focus electrode lead connection; and an input body assembly comprising:

an anode configured to be adjustably held in place with respect to and in proximity to the cathode and further configured such that an anode voltage potential can be applied to the anode;

a magnetic gun polepiece fixed with respect to the anode but adjustably held in place with respect to the cathode; wherein the input body assembly and the gun header assembly are mechanically coupled using a flexible bellows that enables the input body to be translated axially with respect to the gun header assembly such that a distance between the anode and the cathode and a distance between the magnetic gun polepiece and the cathode can be adjusted; and wherein a magnetic flux adjustment shield having a substantially cylindrical shape is located outside of the gun header assembly and configured to slide along an axial direction, wherein a magnetic field inside of the gun header assembly is modified depending on an axial position of the magnetic flux adjustment shield.

2. The electron gun assembly of claim 1, wherein the flexible bellows is constructed from a material that is nonmagnetic.

3. The electron gun assembly of claim 1, wherein the anode is configured to have a geometry that is substantially ring-shaped such that the anode includes a central void through which the electron beam can propagate.

4. The electron gun assembly of claim 3, wherein the anode is configured such that the electron gun assumes a Pierce configuration.

5. The electron gun assembly of claim 1, wherein a heater assembly is further disposed adjacent to the cathode such that the cathode can be heated to enable thermionic electron emission.

6. The electron gun assembly of claim 1, wherein the input body assembly further comprises a plurality of magnetic polepieces separated by nonmagnetic spacers to form a drift region for the electron beam.

7. The electron gun assembly of claim 1, wherein the plurality of ceramic isolating rings comprises an alumina ceramic material.

8. The electron gun assembly of claim 1, wherein the gun header assembly further includes a nonmagnetic gun shield having a substantially cylindrical shape and configured to substantially enclose the gun header assembly.

9. The electron gun assembly of claim 1, wherein the gun header assembly further includes a magnetic gun adjustment disk surrounding the magnetic gun polepiece, wherein the magnetic gun adjustment disk is configured to transmit magnetic flux from the magnetic gun polepiece to the magnetic flux adjustment shield.

10. The electron gun assembly of claim 1, wherein a grid is electrically connected to the focus electrode and fixed in place adjacent to the cathode, such that the focus electrode voltage bias is also applied to the grid.

11. An electron gun assembly comprising:

a gun header assembly comprising:

a cathode adapted to emit an electron beam, wherein the cathode is coupled to a cathode lead connection permitting a cathode voltage bias to be applied to the cathode and further wherein a heater assembly is coupled to the cathode such that the cathode can be heated to induce thermionic electron emission;

a focus electrode fixed in position adjacent to the cathode but electrically isolated from the cathode, wherein the focus electrode is further coupled to a focus electrode lead connection permitting a focus electrode voltage bias to be applied to the focus electrode;

a plurality of ceramic isolating rings comprised of an alumina ceramic material and fixed in position such that at least one of the plurality of ceramic isolating rings provides electrical isolation between the cathode lead connection and the focus electrode lead connection;

a nonmagnetic gun shield having a substantially cylindrical shape and configured to substantially enclose the cathode, the focus electrode, and the plurality of ceramic isolating rings;

a magnetic gun adjustment disk having a cylindrical opening; and a magnetic flux adjustment shield having a substantially cylindrical shape, located outside of the nonmagnetic gun shield, and configured to slide along an axial direction, wherein a magnetic field inside of the gun header assembly is modified depending on an axial position of the magnetic flux adjustment shield; and an input body assembly comprising:

an anode configured to be adjustably held in place with respect to and in proximity to the cathode and further configured such that an anode voltage potential can be applied to the anode; and a magnetic gun polepiece fixed with respect to the anode but adjustably held in place with respect to the cathode; wherein the input body assembly and the gun header assembly are mechanically coupled using a flexible bellows comprising a nonmagnetic material and that enables the input body to be translated axially with respect to the gun header assembly such that a distance between the anode and the cathode and a distance between the magnetic gun polepiece and the cathode can be adjusted and such that the cylindrical opening of the magnetic gun disk is positioned to surround the magnetic gun polepiece.

12. The electron gun assembly of claim 11, wherein the anode is configured to have a geometry that is substantially ring-shaped such that the anode includes a central void through which the electron beam can propagate.

13. The electron gun assembly of claim 12, wherein the anode is configured such that the electron gun assumes a Pierce configuration.

14. The electron gun assembly of claim 11, wherein the input body assembly further comprises a plurality of magnetic polepieces separated by nonmagnetic spacers to form a drift region for the electron beam.

15. The electron gun assembly of claim 11, wherein a grid is electrically connected to the focus electrode and fixed in place adjacent to the cathode, such that the focus electrode voltage bias is also applied to the grid.

* * * * *